US005471689A

United States Patent [19]

Shaw et al.

[11] Patent Number: 5,471,689

[45] Date of Patent: Dec. 5, 1995

[54] BED HANDLE SYSTEM

[76] Inventors: Juliann P. Shaw; Bon F. Shaw, both of 1538 Sugarwood Cir., Winter Park, Fla. 32792

[21] Appl. No.: 324,757

[22] Filed: Oct. 4, 1994

[51] Int. Cl.[6] ..... A61G 7/06

[52] U.S. Cl. ..... 5/662; 5/426; 5/659; 5/925

[58] Field of Search ..... 5/425, 426, 427, 5/428, 429, 662, 659, 925

[56] References Cited

U.S. PATENT DOCUMENTS

| | | | |
|---|---|---|---|
| 1,915,774 | 6/1923 | Busch | 5/426 |
| 2,071,155 | 2/1937 | Alexander | 5/426 X |
| 2,555,228 | 5/1957 | Evers | 5/426 |
| 2,859,454 | 11/1958 | Beckwell | 5/331 |
| 2,904,799 | 9/1959 | Berlin | 5/331 |
| 3,290,701 | 12/1966 | Luff | 5/426 |
| 3,474,473 | 10/1969 | Hannaberg | 5/426 |
| 4,570,275 | 2/1986 | Merriman | 5/429 X |
| 4,827,545 | 5/1989 | Arp | 5/424 |
| 4,833,743 | 5/1989 | Howell et al. | 5/426 |
| 5,044,025 | 9/1991 | Hunsinger et al. | 5/424 |
| 5,175,897 | 1/1993 | Marra, Jr. | 5/425 |
| 5,191,663 | 3/1993 | Holder et al. | 5/424 |

*Primary Examiner*—Michael F. Trettel

*Attorney, Agent, or Firm*—Allen, Dyer Doppelt, Franjola & Milbrath

[57] ABSTRACT

The bed handle system of the present invention, which includes a pair of handle elements, is used for facilitating movement into and out of a bed. Each handle element can be anchored to a bed mattress and has an upwardly extending handle section dimensioned to extend above the bed mattress. In use the handle portion is positioned adjacent a first side of the mattress, and the pair of handle elements are positioned in spaced relation to each other. The spacing between the handle elements may be adjusted to permit a user to grasp one handle section with each hand and to sit between the elements on the mattress preparatory to moving into or out of the bed.

12 Claims, 1 Drawing Sheet

BED HANDLE SYSTEM

BACKGROUND OF THE INVENTION

1. Field of the Invention

The present invention relates to safety devices and, more particularly, to rail and handle systems for beds.

2. Description of Related Art

Protective rail systems are known that are affixed to the sides of a bed to prevent a baby, child, or someone having diminished motor control from falling out of bed. Typically these rail systems, such as those on hospital-type beds, must be raised when the person is in the bed and lowered when he or she wishes to arise. This raising and lowering generally must be performed by a second person standing by the side of the bed.

Bedside guard and rail systems designed to be used with non-hospital-type beds are also known in the art, such as those disclosed by Evers (U.S. Pat. No. 2,555,228), Beckwell (U.S. Pat. No. 2,859,454), Berlin (U.S. Pat. No. 2,904,799), and Howell et al (U.S. Pat. No. 4,833,743). A common feature to these guards is that they comprise a unitary, centrally placed rail having an inverted U-shaped portion extending above the surface of the mattress and a stabilizing portions extending under the mattress, generally meeting the upwardly extending portion at right angles.

It has also been known that such rail systems may be covered or padded to prevent a portion of the body from slipping through the upwardly extending portion and also to present a more forgiving surface to the child or patient should he or she lean against the rail. Such covered or padded bedside guards are disclosed by Evers (U.S. Pat. No. 2,555,228), Arp (U.S. Pat. No. 4,827,545), Howell et al. (U.S. Pat. No. 4,833,743), Hunsinger et al. (U.S. Pat. No. 5,044,025), Marra, Jr. (U.S. Pat. No. 5,175,897), and Holder et al. (U.S. Pat. No. 5,191,663).

SUMMARY OF THE INVENTION

It is an object of this invention to provide a bed handle system that permits the user to enter and leave the bed without assistance without altering the position of the system.

It is a further object to provide such a system having variable spacing between the handle elements.

It is an additional object to provide such a system wherein the handles are each dimensioned to be removably covered with a standard pillowcase.

It is another object to provide such a system that can be installed without lifting the mattress of the bed.

It is yet a further object to provide such a system that can remain in place when the bed sheets are being replaced.

These and additional objects are achieved with the bed handle system of the present invention, which is used for facilitating movement into and out of a bed. This system comprises a pair of handle elements. Each handle element has means for being anchored to a bed mattress and an upwardly extending handle section connected to the anchoring means. The handle section is dimensioned to extend above the bed mattress. In use the handle portion is positioned adjacent a first side of the mattress, and the pair of handle elements are positioned in spaced relation to each other. The spacing between the handle elements may be adjusted to permit a user to grasp one handle section with each hand and to sit between the elements on the mattress preparatory to moving into or out of the bed. While the system of the present invention serves to keep the user from falling out of bed, as with previously disclosed bed rails, this arrangement offers the additional feature of permitting a person using a cane, a walker, or a wheelchair who has use of the upper body but diminished use of the lower body to help him/herself into and out of bed without the aid of a second person; this is an important advantage over previously disclosed systems. The system additionally provides further security for a person who may experience dizziness getting into or out of a bed. The invention also permits a physically challenged person to continue using a standard bed instead of undergoing the expense and isolation associated with a hospital-type bed.

An alternate method of getting into bed from a wheelchair with the aid of the present invention comprises positioning the wheelchair facing the bed between the handle elements, swinging the legs onto the bed between the handle elements, and using the arms to push the rest of the body onto the bed.

In a preferred embodiment, the anchoring means of the handle element comprises two generally parallel bracing legs connected at either end of the upwardly extending handle section. Each bracing leg extends in a same direction from the handle section at a generally right angle. The anchoring is accomplished by placing the bracing legs beneath the mattress, typically between the mattress and box springs, so that the weight of the mattress prevents the handle element from moving. When the bed handle system is to be used with a waterbed or a platform-type bed, the bracing legs are instead positioned between the mattress and the platform on which the mattress rests.

Also in a preferred embodiment, the handle section of each handle element has a pair of upwardly extending arms having a lower end and an upper end. Each arm is connected at the lower end to a corresponding one of the bracing legs. The handle section further has a generally horizontal portion connected to the upper end of each arm, the handle section thereby forming an inverted U-shaped structure. The horizontal portion is typically the section that is grasped by the user when maneuvering into or out of the bed.

The handle section, in a preferred embodiment, is dimensioned to be coverable by a standard-size pillowcase. This dimensioning permits the user to cover the exposed portion of the handle element with a common household item that is inexpensive, easily washable, and replaceable.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

DETAILED DESCRIPTION OF THE PREFERRED EMBODIMENTS

Figure 1:
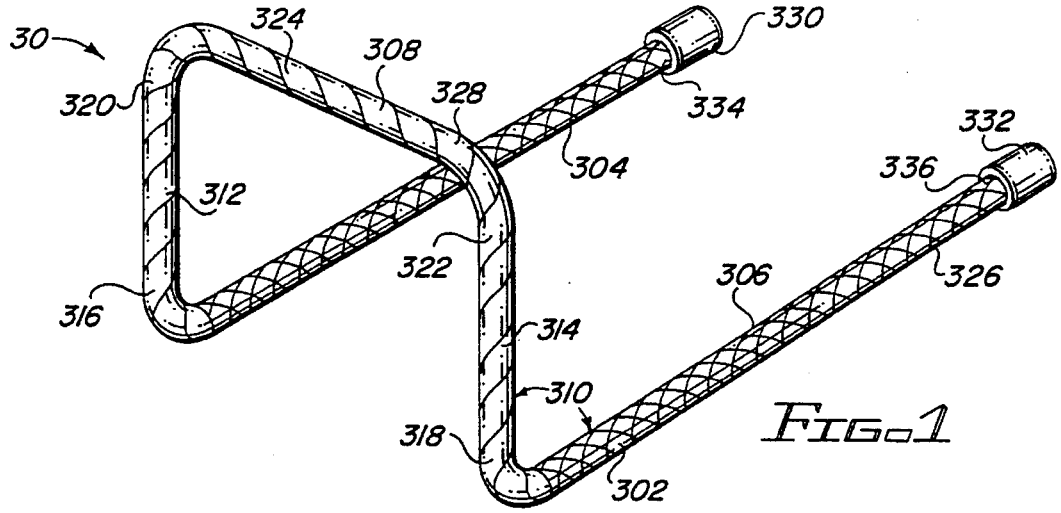
FIG. 1 illustrates one of the handle elements of the present invention.

A description of the preferred embodiments of the present invention will now be presented with reference to FIGS. 1 and 2.

Figure 2:
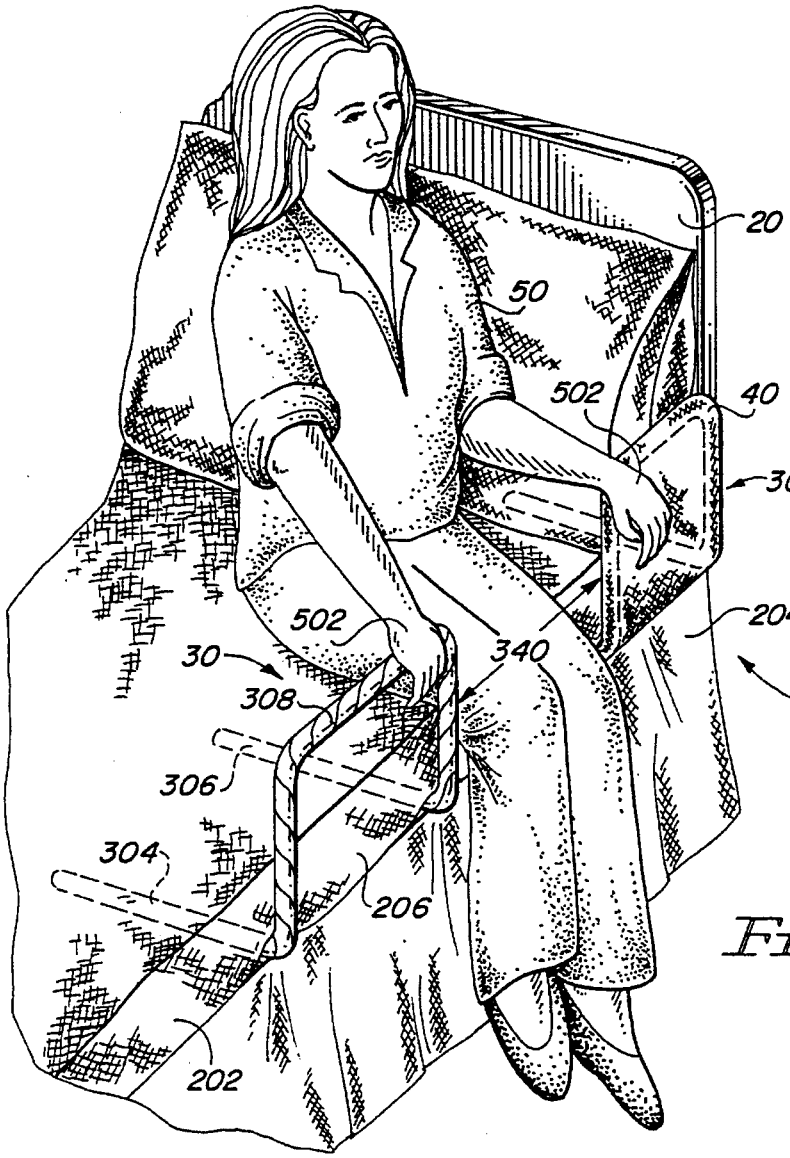
FIG. 2 is a side view of the bed handle system of the present invention installed on a bed, and also depicts a user preparing to exit a bed with the aid of the bed handle system.

The bed handle system of the present invention, shown installed in FIG. 2 and referred to generally by the reference numeral 10, facilitates movement into and out of a bed 20. The system 10 comprises a pair of handle elements 30, shown in detail in FIG. 1, and each handle element 30 comprises an integral length of tubing 302 that has two generally parallel bracing legs 304 and 306 and a handle section 308 connecting the bracing legs 304 and 306. The handle section 308 is dimensioned to extend above a bed mattress 202 and to be coverable by a standard-size pillowcase 40. Each bracing leg 304 and 306 extends in a same direction from the handle section 308 at a generally right angle 310.

The handle section 308 of each handle element 30 has a pair of upwardly extending arms 312 and 314, each having a lower end 316,318 and an upper end 320,322, respectively. Each arm 312,314 is connected at the lower end 316,318 to a corresponding one of the bracing legs 304,306. The handle section 308 further has a generally horizontal portion 324 connected to and bridging the upper ends 320,322 of arms 312,314. Thus the handle section 308 thereby forms an inverted U-shaped structure. In a preferred embodiment, the tubing 302 comprises electrical metallic tubing (EMT), 10 feet long, of diameter ½ inch. This has been shown to be sufficiently strong to withstand 300 pounds compression. Each bracing leg portion 304,306 is approximately 3 feet long; the arms 312,314 are approximately 15 inches each, and the horizontal portion 324 is approximately 20 inches long.

At least a part of the bracing legs 304 and 306 is encompassed by a vinyl sleeve 326. In a preferred embodiment the sleeve 326 has frictional properties for reducing potential slippage between the bracing legs 304,306, the mattress 202, and the box springs 204. A particular embodiment of the sleeve 326 comprises ½-inch-diameter low-density polyethylene extruded plastic tubular sleeving with a diamond-pattern open-mesh construction.

In order to reduce potential slippage between the handle section 308 and the hands of a user and further to provide grip comfort to the user, a strip of vinyl 328 is wrapped about the handle element 30 to surround at least the horizontal portion. The vinyl strip 328 contributes grippability and cushioning properties to handle section 308, and may comprise a wrap such as those used on bicycle handlebars or tennis racquets. With the addition of the vinyl strip 328, the grip diameter becomes approximately ⅞ inch.

A further component of handle element 30 comprises a pair of feet 330 and 332. One foot 330,332 is affixed to a distal end 334,336 of each bracing leg 304,306, respectively, for protecting the mattress. Typically these feet 330,332 comprise plastic endcaps dimensioned to slip over the ends 334,336 of the bracing legs 304,306, and they serve the purpose of preventing tears and abrasion in the mattress 202 and box springs 204.

In use the bracing legs 304 and 306 of each handle element 30 are placed beneath the mattress 202. The handle section 308 is positioned adjacent a first side 206 of the mattress 202, and the pair of handle elements 30 are positioned in spaced relation. The spacing 340 between handle elements 30 may be adjusted to permit a user 50 to grasp one handle section 308 with each hand 502 and to sit between the elements 30 on the mattress 202 preparatory to moving into or out of the bed 20, as shown in FIG. 2. Given the dimensions indicated for the preferred embodiment, spacing 340 can range from 27 inches for a twin or full-size bed up to 32 inches for a queen- or king-size bed.

One feature of the invention is that the mattress 202 need not be lifted to install the system 10, since the legs 304,306 can be inserted between the mattress 202 and box springs 204 with a sliding motion. A second feature is that the system 10 need not be removed in order to change the sheets; each handle 30 merely needs to be pulled out a few inches from the mattress 202 prior to the changing operation.

In the situation mentioned above wherein the system 10 is utilized with a waterbed or platform-type bed, typically the mattress 202 rests upon a platform having upwardly extending sides. The installation for this embodiment entails lifting the mattress 202 and placing the legs 304,306 beneath the mattress 202 and atop the platform, the upwardly extending arms 312,314 thus being retained between the side of the mattress 202 and the upwardly extending sides of the bed. For a waterbed, some of the water may be emptied in order to facilitate the lifting step. In these embodiments, of course, the handles 30 cannot be pulled out for sheet changing.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A bed handle system for facilitating movement into and out of a bed, the system comprising:

a pair of handle elements, each handle element having two generally parallel bracing legs and an upwardly extending handle section connecting the bracing legs, the handle section dimensioned to extend above a bed mattress, each bracing leg extending in a same direction from the handle section at a generally right angle; and a first material encompassing at least a part of the bracing legs, the first material having frictional properties for reducing potential slippage between the bracing legs and the mattress;

wherein in use the bracing legs of each handle element are placed beneath the mattress, the handle portion is positioned adjacent a first side of the mattress, and the pair of handle elements are positioned in spaced relation, the spacing adjusted to permit a user to grasp one handle section with each hand and to sit between the elements on the mattress preparatory to moving into or out of the bed.

2. The bed handle system recited in claim 1, wherein the handle section of each handle element has a pair of upwardly extending arms having a lower end and an upper end, each arm connected at the lower end to a corresponding one of the bracing legs, and a generally horizontal portion connected to the upper end of each arm, the handle section thereby forming an inverted U-shaped structure.

3. The bed handle system recited in claim 2, wherein each handle element comprises an integral length of tubing.

4. The bed handle system recited in claim 3, wherein the tubing comprises electrical metallic tubing having sufficient strength to withstand 300 pounds of compressive force.

5. A bed handle system for facilitating movement into and out of a bed, the system comprising:

a pair of handle elements, each handle element comprising an integral length of tubing and having two generally parallel bracing legs and an Upwardly extending handle section connecting the bracing legs, the handle section dimensioned to extend above a bed mattress, each bracing leg extending in a same direction from the handle section at a generally right angle, the handle section having a pair of upward by extending arms having a lower end and an upper end, each arm connected at the lower end to a corresponding one of the bracing legs, and a generally horizontal portion connected to the upper end of each arm, the handle section thereby forming an inverted U-shaped structure;

wherein in use the bracing legs of each handle element are placed beneath the mattress, the handle portion is positioned adjacent a first side of the mattress, and the pair of handle elements are positioned in spaced relation, the spacing adjusted to permit a user to grasp one handle section with each hand and to sit between the elements on the mattress preparatory to moving into or out of the bed; and wherein the bracing legs further comprise a first material encompassing at least a part of the bracing legs, the first material having frictional properties for reducing potential slippage between the bracing legs and the mattress.

6. The bed handle system recited in claim 5, wherein the first slip-reducing material comprises a vinyl sleeve dimensioned to surround a bracing leg.

7. The bed handle system recited in claim 5, wherein the handle section further comprises a second material surrounding at least the horizontal portion, the second material having grippability properties for reducing potential slippage between the upwardly extending section and the hands of a user.

8. The bed handle system recited in claim 7, wherein the second slip-reducing material further has cushioning properties for providing grip comfort to the user.

9. The bed handle system recited in claim 2, wherein the handle section is dimensioned to be coverable by a standard-size pillowcase.

10. The bed handle system recited in claim 5, wherein the handle section is dimensioned to be coverable by a standard-size pillowcase.

11. The bed handle system recited in claim 5, wherein the tubing comprises electrical metallic tubing having sufficient strength to withstand 300 pounds of compressive force.

12. A bed handle system for facilitating movement into and out of a bed, the system comprising a pair of handle elements, each handle element comprising:

an integral length of tubing having:

two generally parallel bracing legs; and a handle section connecting the bracing legs, the handle section dimensioned to extend above a bed mattress and to be coverable by a standard-size pillowcase, each bracing leg extending in a same direction from the handle section at a generally right angle;

a vinyl sleeve encompassing at least a part of the bracing legs, the sleeve having frictional properties for reducing potential slippage between the bracing legs and the mattress;

a strip of vinyl wrapped about the handle element to surround at least a portion of the handle section, the vinyl strip having grippability properties for reducing potential slippage between the handle section and the hands of a user and further having cushioning properties for providing grip comfort to the user; and a pair of feet, one foot affixed to a distal end of each bracing leg, for protecting the mattress;

wherein the handle section of each handle element has a pair of upwardly extending arms having a lower end and an upper end, each arm connected at the lower end to a corresponding one of the bracing legs, and a generally horizontal portion connected to and bridging the upper ends of the arms, the handle section thereby forming an inverted U-shaped structure; and wherein in use the bracing legs of each handle element are placed beneath the mattress, the handle section is positioned adjacent a first side of the mattress, and the pair of handle elements are positioned in spaced relation, the spacing adjusted to permit a user to grasp one handle section with each hand and to sit between the elements on the mattress preparatory to moving into or out of the bed.

* * * * *